US008448404B2

(12) United States Patent
Johnson, III

(10) Patent No.: US 8,448,404 B2
(45) Date of Patent: May 28, 2013

(54) BOND BEAM REBAR POSITIONER

(75) Inventor: Ralph O. Johnson, III, Charlotte, NC (US)

(73) Assignee: Masonry Reinforcing Corporation of America, Charlotte, NC (US)

( * ) Notice: Subject to any disclaimer, the term of this patent is extended or adjusted under 35 U.S.C. 154(b) by 99 days.

(21) Appl. No.: 13/153,970

(22) Filed: Jun. 6, 2011

(65) Prior Publication Data

US 2012/0304586 A1 Dec. 6, 2012

(51) Int. Cl.

| | |
|---|---|
| ***E04C 5/16*** | (2006.01) |
| ***E04C 5/00*** | (2006.01) |
| ***E04B 1/38*** | (2006.01) |

(52) U.S. Cl.
USPC ..... 52/677; 52/712

(58) Field of Classification Search
USPC ..... 52/677, 686, 687, 712, 649.7; 248/302
See application file for complete search history.

(56) References Cited

U.S. PATENT DOCUMENTS

| | | | | |
|---|---|---|---|---|
| 4,107,895 | A * | 8/1978 | LeGrady | 52/687 |
| 6,629,394 | B1 | 10/2003 | Trevino | |
| D582,258 | S | 12/2008 | Ripley et al. | |
| 8,122,675 | B2 * | 2/2012 | Ripley et al. | 52/687 |
| 2005/0133684 | A1 | 6/2005 | Maguire | |
| 2007/0157541 | A1 | 7/2007 | Mossbeck et al. | |
| 2007/0240378 | A2 * | 10/2007 | Crowell | 52/677 |
| 2008/0134617 | A1 * | 6/2008 | Ripley et al. | 52/677 |
| 2008/0172975 | A1 | 7/2008 | Manware et al. | |
| 2010/0281814 | A1 * | 11/2010 | Ripley et al. | 52/677 |
| 2012/0227350 | A1 * | 9/2012 | Wester | 52/687 |
| 2012/0304586 | A1 * | 12/2012 | Johnson, III | 52/677 |

* cited by examiner

*Primary Examiner* — Andrew Triggs
(74) *Attorney, Agent, or Firm* — Shumaker, Loop & Kendrick, LLP

(57) ABSTRACT

A bond beam rebar positioner including a center segment having an undulating form positioned between first and second legs, each of the legs including a first segment arranged perpendicular to a notional straight line longitudinally bisecting the curves of the center segment, a second segment perpendicular to the first segment, parallel to the straight line, and in a direction away from the center segment, and a third segment perpendicular to the second segment, coplanar with the second segment, and perpendicular to a common plane of the center, first and second segments.

13 Claims, 18 Drawing Sheets

Fig. 6
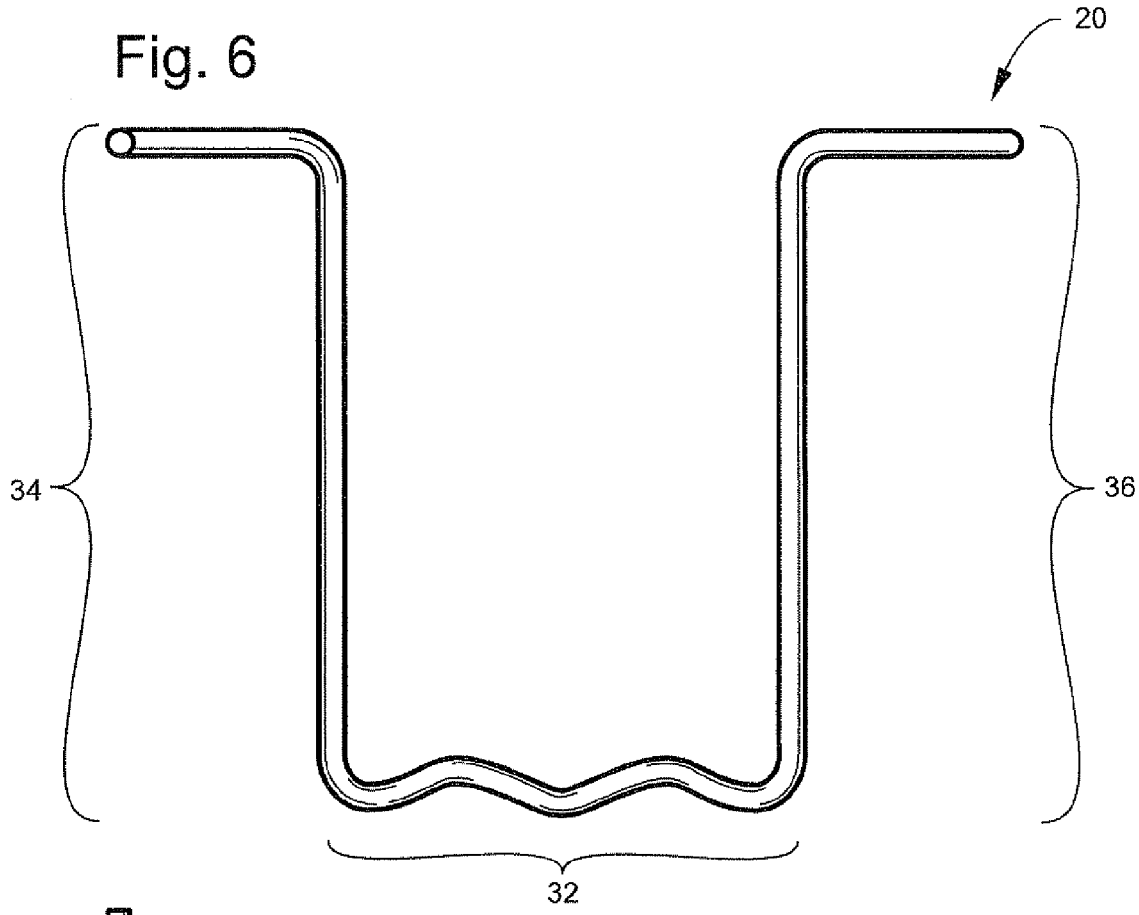
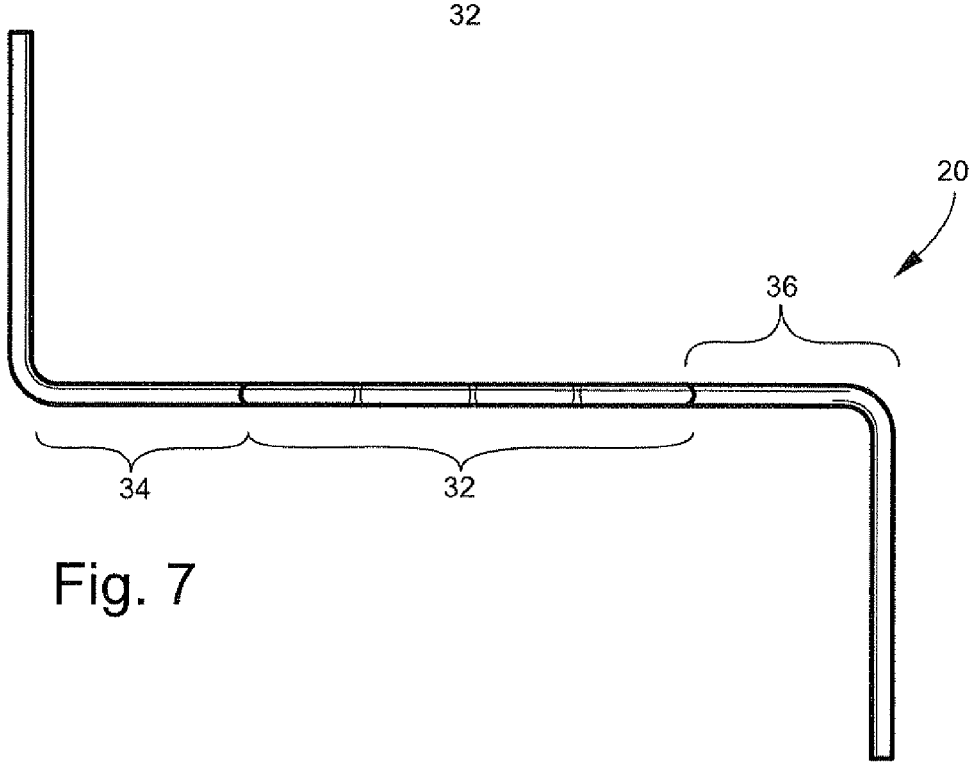
Fig. 7

BOND BEAM REBAR POSITIONER

BACKGROUND

Bond beams are structural beams used in concrete masonry construction. In exemplary applications, bond beams can be installed as a continuous course of a wall or above and below windows to provide structural support. Bond beams are typically constructed by arranging blocks having a specific sectional profile in an end-to-end manner such that the blocks form a continuous channel. Rebar is then positioned in the channel, and the channel is filled with concrete to embed the rebar and form a substantially solid beam.

Bond beam concrete clocks typically have either a U-shaped or a W-shaped cross-sectional profile, depending on wall thickness. U-shaped blocks arranged end-to end thus form a single continuous channel, and W-shaped blocks arranged end-to-end form two parallel, continuous channels.

It is desirable to position the rebar within the bottom one third of the channel(s). It is also desirable to position the rebar elevated off the bottom of the block and positioned apart from the sides of the block to ensure proper embedding within the poured concrete. Conventional methods for positioning rebar within a channel include using tables, which are essentially stands that the rebar sits on during the concrete pouring process. Tables are disadvantageous in that they often tip or shift in position during the pouring process, resulting in uneven spacing of the rebar with respect to the walls of the channel and/or with respect to parallel positioned lengths of rebar, both of which degrade the structural performance of the bond beam.

Accordingly, what is desired is a way of positioning rebar within a channel(s) of a bond beam to maintain the position of the rebar during the concrete pouring process to ensure proper embedding, proper spacing of the embedded rebar with respect to the bottom and sides of the block, and proper spacing with respect to parallel lengths of rebar, in the finished bond beam. Various embodiments of such devices are provided herein.

BRIEF SUMMARY

In one aspect, various embodiments of rebar positioners are provided herein for use in bond beam construction.

In another aspect, the rebar positioners ensure proper spacing of rebar with respect to the bottom and sides of a channel of a bond beam.

In another aspect, the rebar positioners ensure proper spacing between parallel lengths or rebar within a channel or within adjacent channels of a bond beam.

In another aspect, rebar positioners are provided herein for positioning rebar within bond beams having generally U-shaped and W-shaped sectional profiles.

In another aspect, the rebar positioners are constructed from a continuous length of bent wire.

In another aspect, the rebar positioners can be positioned within a single bond beam concrete block or between adjacent blocks.

In another aspect, the rebar positioners seat upon and are supported by the tops of the bond beam blocks.

In another aspect, the rebar positioners are positioned at spaced-apart intervals along the length of a bond beam channel.

In another aspect, the rebar positioners are universal and configured to accommodate any rebar diameter.

To achieve the forgoing and other aspects, in a first embodiment a rebar positioner is provided herein for positioning rebar within a channel of a bond beam. The rebar positioner is constructed from a single continuous piece of wire bent to generally define a center segment centered between first and second legs. The center segment has an undulating form including a plurality of successive curves in alternate directions. The first and second legs extend vertically upwardly from the center segment in substantially the same direction. Each of the first and second legs generally include three segments: a first segment arranged substantially perpendicular with respect to a notional straight line longitudinally bisecting the undulating center segment; a second segment arranged perpendicular to the first segment, substantially parallel to the notional straight line bisecting the center segment, and in the direction away from the center segment; and a third segment arranged substantially perpendicular to the second segment, coplanar with the second segment, and in a direction perpendicular to a common plane of the center segment, first segment and second segment. The third segments of the first and second legs are substantially parallel, but extend in opposite directions perpendicular from the common plane of the center segment, first segment and second segment.

In a further embodiment, the first embodiment of the rebar positioner has a width and depth corresponding to a U-shaped bond beam block such that the center segment is positioned at least about 1" from a bottom surface of a channel of the block and the first segments of each of the first and second legs are positioned at least about ½" from the sidewalls of the channel of the bond beam block.

In a second embodiment, a rebar positioner is provided herein for positioning rebar within parallel channels of a bond beam. The rebar positioner is constructed from a single continuous piece of wire bent to generally define a center segment centered between first and second legs. The center segment has an undulating form including a plurality of successive curves in alternate directions. The first and second legs extend vertically upwardly from the center segment. Each of the first and second legs generally include three segments: a first segment arranged substantially perpendicular with respect to a notional straight line longitudinally bisecting the undulating center segment; a second segment arranged perpendicular to the first segment, substantially parallel to the notional straight line bisecting the center segment, and in the direction away from the center segment; and a third segment arranged substantially perpendicular to the second segment, coplanar with the second segment, and in a direction perpendicular to the common plane of the center segment, first segment and second segment. The third segments of the first and second legs are substantially parallel but extend in opposite directions perpendicular from the common plane of the center segment, first segment and second segment. The center segment has a length sufficient to span portions of adjacent channels and a center vertical portion of the bond beam block.

In a further embodiment, the second embodiment of the rebar positioner has a width and depth corresponding to a W-shaped bond beam block such that the center segment is positioned at least about 1" from a bottom surface of adjacent channels of the block and the first segments of each of the first and second legs are positioned at least about ½" from the sidewalls of the channels of the bond beam block.

In a third embodiment, a rebar positioner is provided herein for positioning rebar within a channel of a bond beam. The rebar positioner is constructed from a single continuous piece of wire bent to generally define first and second parallel arranged, spaced-apart center segments, each center segment being arranged between first and second legs. Each center segment has an undulating form including a plurality of successive curves in alternate directions. The first and second legs of each center segment extend vertically upwardly from the center segment. Each of the first and second legs generally include three segments: a first segment arranged substantially perpendicular with respect to a notional straight line longitudinally bisecting the undulating center segment; a second segment arranged perpendicular to the first segment, substantially parallel to the notional straight line bisecting the center segment, and in the direction away from the center segment; and a third segment arranged substantially perpendicular to the second segment, coplanar with the second segment, and in a direction perpendicular to the common plane of the center segment, first segment and second segment. The third segments of the first legs of each of the center segments are connected to form a single, common third segment. The third segments of each of the second legs of each of the center segments are arranged in the direction toward one another but are separated by a break, necessitated by constructing the third embodiment of the rebar positioner from a single continuous piece of wire.

In a further embodiment, the third embodiment of the rebar positioner has a width and depth corresponding to a U-shaped bond beam block such that the center segments are positioned at least about 1" from a bottom surface of the channel of the block and the first segments of each of the first and second legs of each of the center segments are positioned at least about ½" from the sidewalls of the channels of the bond beam block.

Additional features, aspects and advantages of the rebar positioners are described in detail below with reference to the drawings.

DESCRIPTION OF THE DRAWINGS

FIGS. 3-9 are various perspective, plan and elevation views of the first embodiment of the rebar positioner;

DESCRIPTION OF THE EMBODIMENTS

Figure 1:
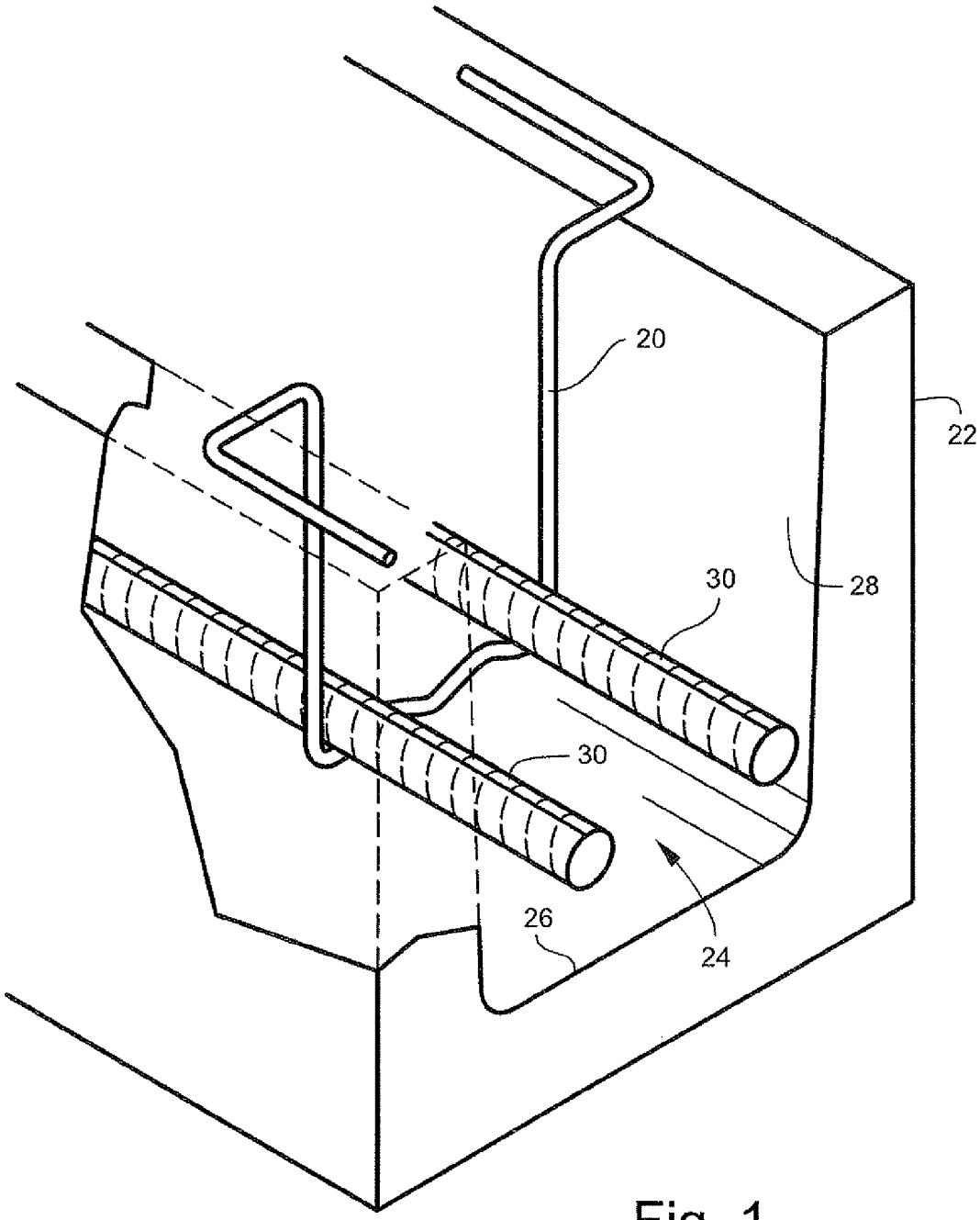
FIG. 1 is a perspective view of a first embodiment of a rebar positioner shown installed in a bond beam masonry block.

Embodiments of a rebar positioner for use in the construction of a bond beam are provided herein with reference to the accompanying drawings. Like reference numbers are used in the drawings to refer to like elements. Although the embodiments of a rebar positioner are described herein as being used in connection with the construction of a bond beams and bond beam masonry blocks, it is envisioned and intended that the embodiments provided herein may be utilized with other construction materials, for other building purposes, and/or for other purposes than rebar support and positioning.

First Embodiment

Figure 2:
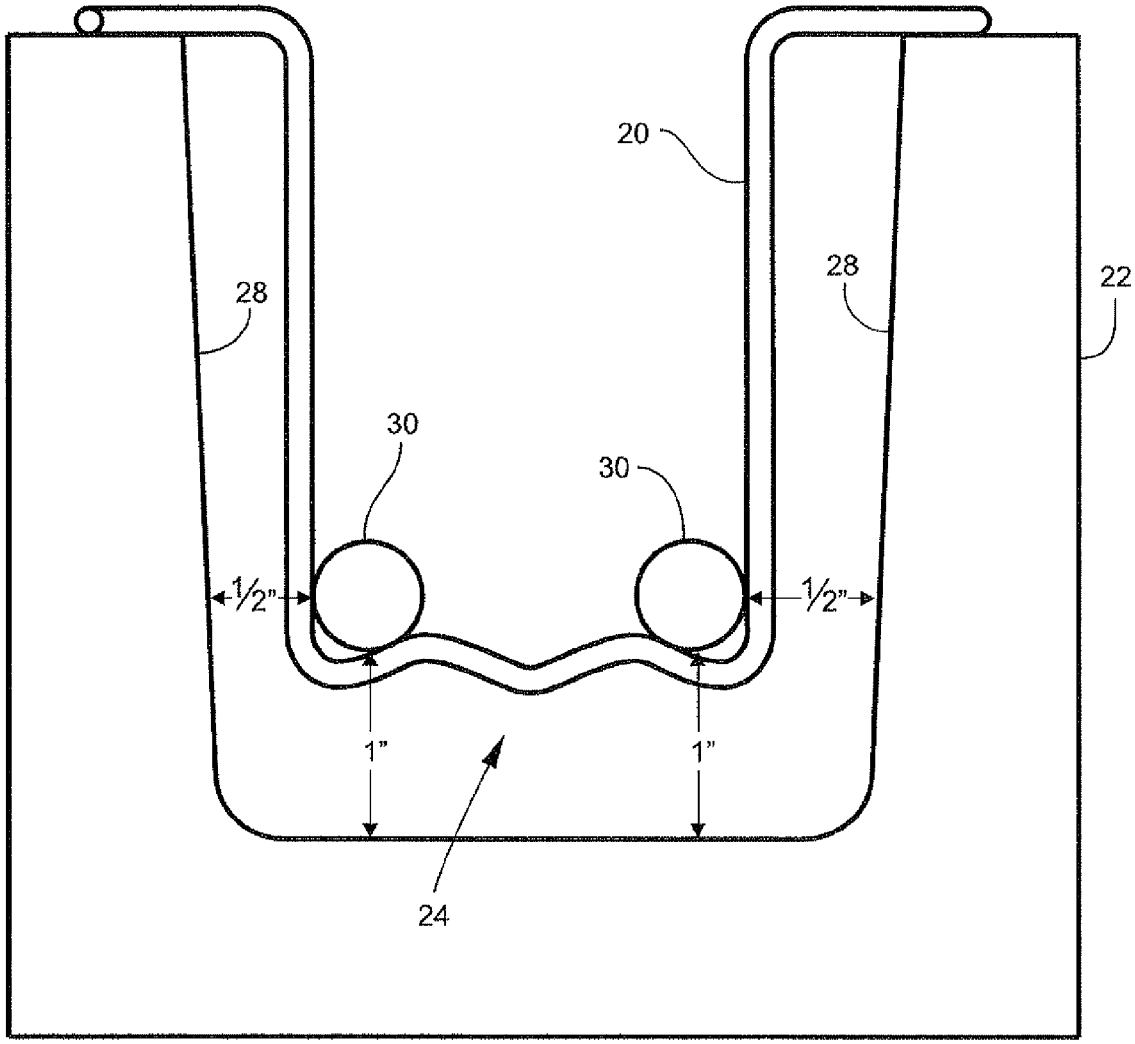
FIG. 2 is a front elevation view of the first embodiment of a rebar positioner shown installed in a bond beam masonry block.
Figure 3:
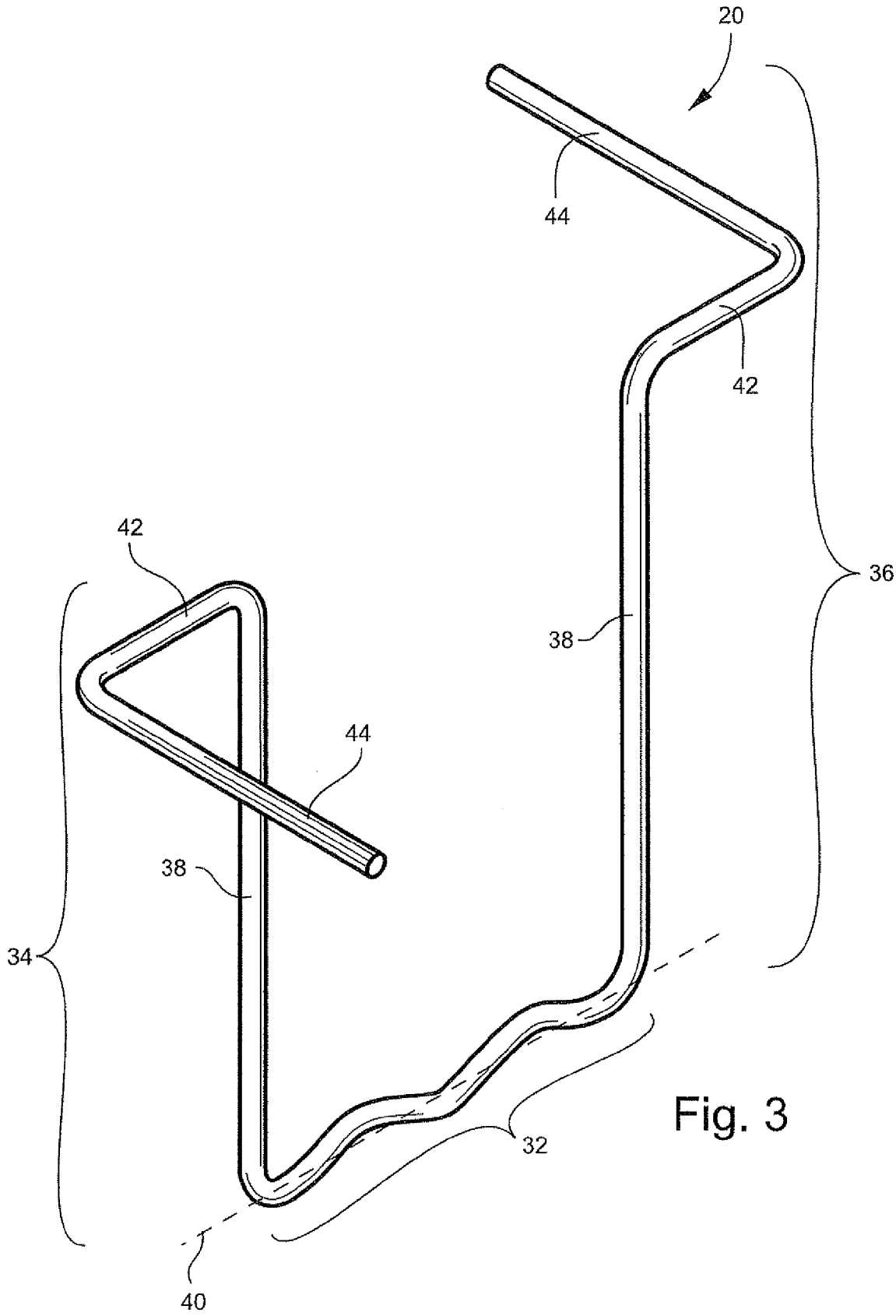
Figure 4:
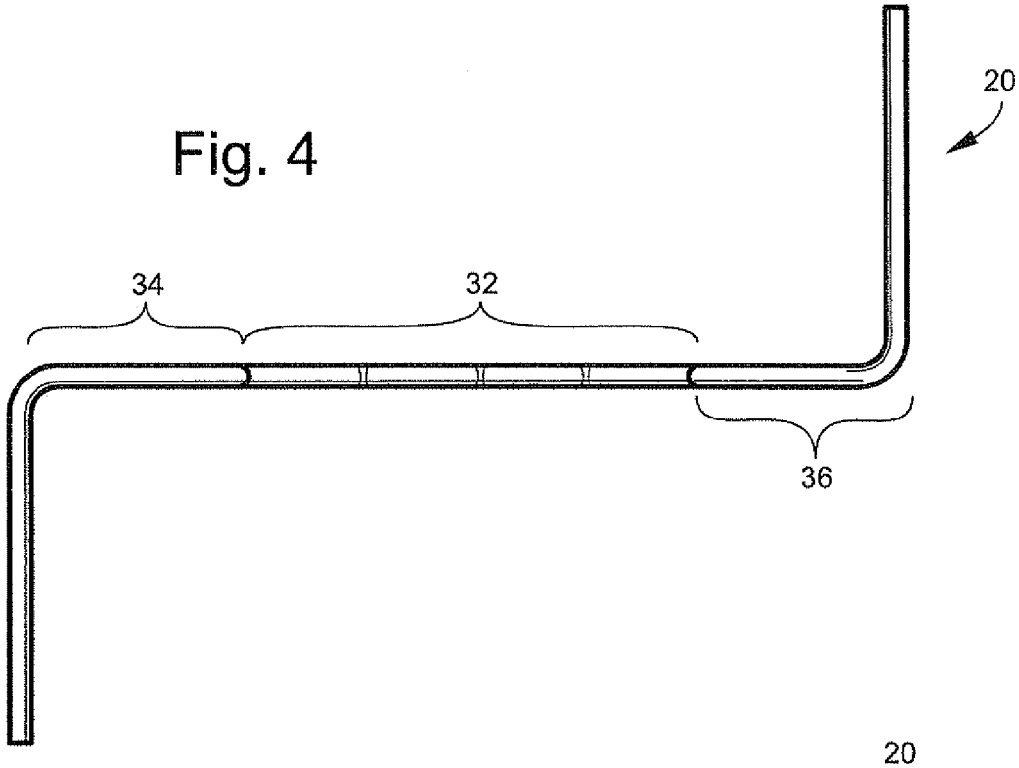
Figure 5:
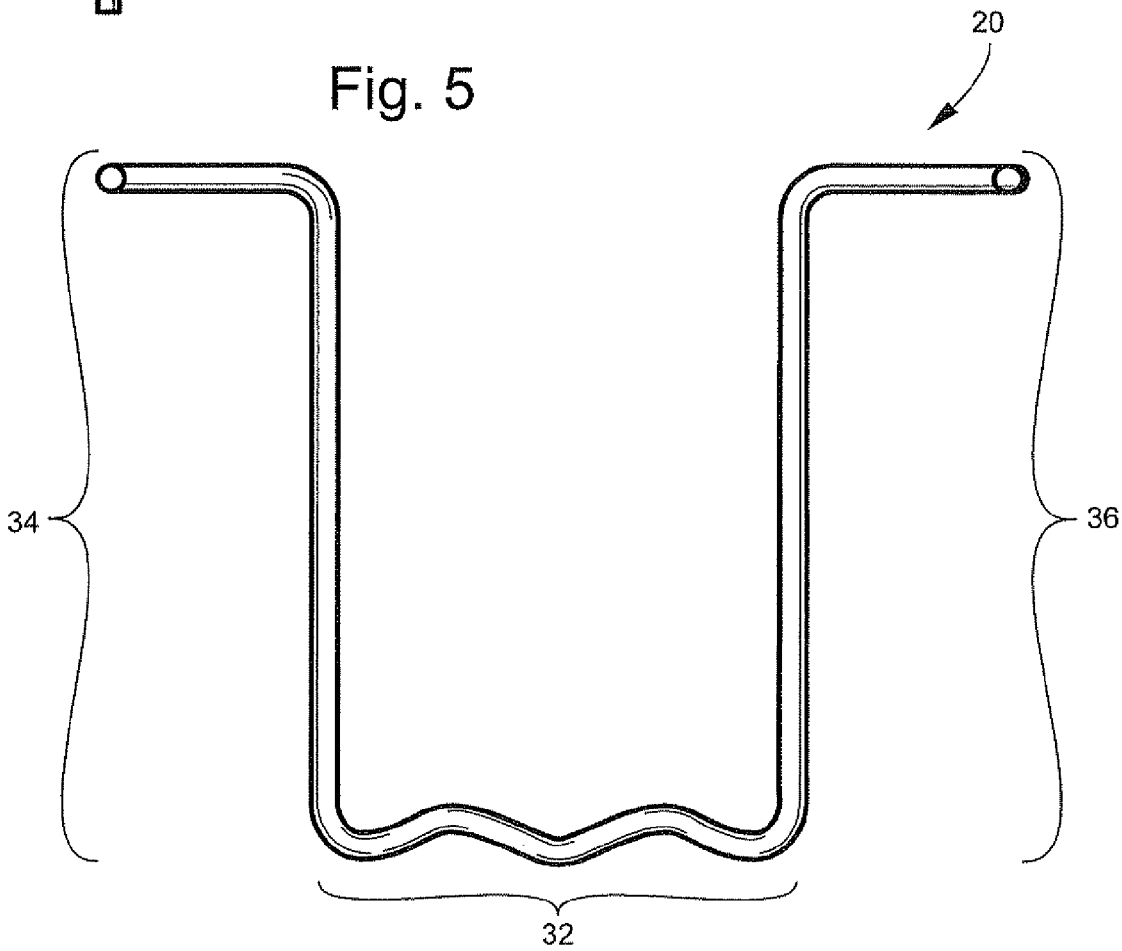
Figure 8:
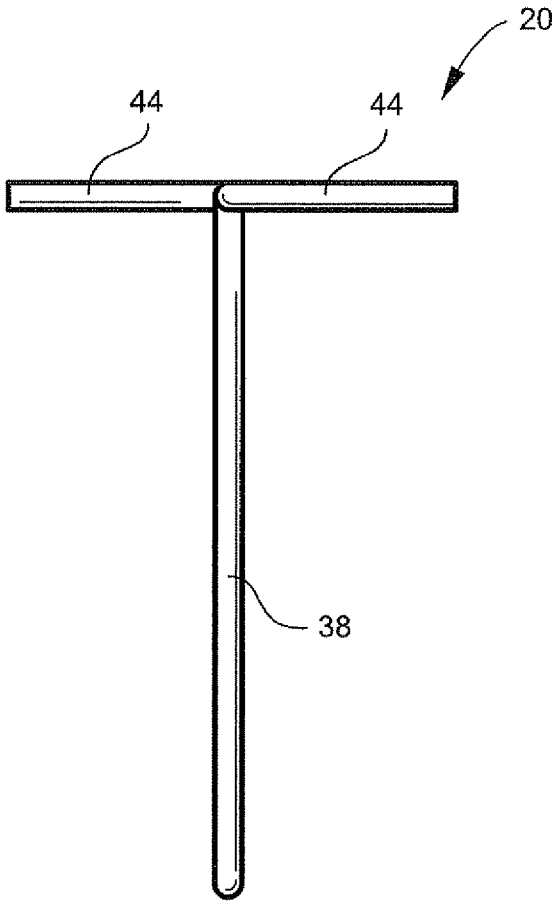
Figure 9:
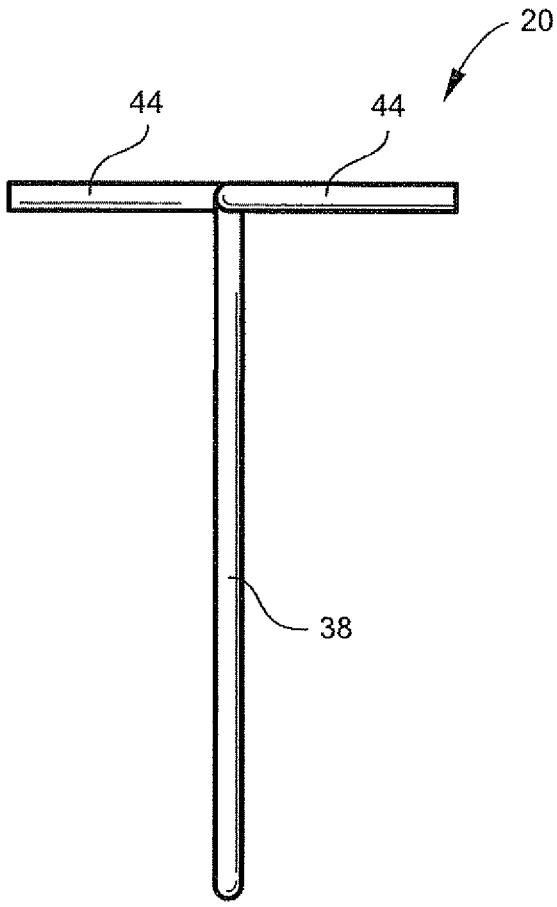

Referring to FIGS. 1-9, a first embodiment of a rebar positioner is shown generally at reference numeral 20. Referring specifically to FIGS. 1-2, rebar positioner 20, in the exemplary application shown, functions to properly position at least one length of rebar within a channel of a bond beam such that the rebar is properly positioned with respect to the bottom and sides of the channel, and with respect to additional lengths or rebar, during bond beam construction.

Exemplary bond beam masonry block 22, referred to herein as simply "block 22," is generally U-shaped and defines a single channel 24 open to the top of the block 22. To construct a structural bond beam, one or more blocks having a common sectional profile are arranged end-to-end to form a continuous channel. Rebar is positioned within the channel using positioner 20, and the channel is subsequently filled with poured concrete, or other material, to embed the rebar and form a substantially solid bond beam. Bond beams can be used, for example, as structural beams between courses of standard concrete blocks.

Block 22 generally defines a flat top surface upon which portions of the legs of positioner 20 seat upon and are supported by. The shape of rebar positioner 20, which is described in detail below with reference to FIGS. 3-9, positions a center segment of positioner 20 elevated from the bottom 26 of the channel 24 and apart from the sides 28 of the channel 24. The center segment of the positioner has an undulating shape for supporting rebar 30 having any diameter. As shown, rebar positioner 20 supports and maintains the position of two parallel-arranged, spaced-apart lengths of rebar 30. In the preferred embodiment, the rebar 30 is spaced-apart from the bottom 26 of the channel 24 at least about 1", and spaced-apart from the sides 28 of the channel 24 at least about ½". These distances may vary depending upon bond beam specifications. Rebar 30 is preferably positioned within the bottom one-third of the bond beam.

Rebar positioners 20 can be installed spaced-apart along the length of the bond beam to support the lengths of rebar 30. The number of rebar positioners 20 required, and the spacing of the intervals, is dependent upon the length and structural specifications of the bond beam. Although rebar positioner 20 is shown in FIG. 1 as being supported by a single block, it is envisioned that portions of the legs may seat upon and be supported by adjacent blocks. The undulating shape of the center segment of rebar positioner 20 allows the positioner to accommodate various diameters of rebar, wherein rebar having a smaller diameter may sit slightly lower in the center segment than rebar having a larger diameter.

Referring specifically to FIGS. 3-9, various perspective, plan and elevation views of rebar positioner 20 are shown. Rebar positioner 20 can be constructed from a single continuous piece of wire bent to generally define a center segment 32 centered between first and second legs 34, 36. The center segment 32 has an undulating form including a plurality of successive curves in alternate directions, preferably at least about five. The first and second legs 34, 36 extend vertically upwardly from the center segment 32 in substantially the same direction.

Each of the first and second legs 34, 36 generally include three segments: a first segment 38 arranged substantially perpendicular with respect to a notional straight line 40 longitudinally bisecting the undulating center segment 32; a second segment 42 arranged perpendicular to the first segment 38, substantially parallel to the notional straight line 40 bisecting the center segment 32, and in a direction away from the center segment 32; and a third segment 44 arranged substantially perpendicular to the second segment 42, coplanar with the second segment 42, and in a direction perpendicular to a common plane of the center segment 32, first segment 38 and second segment 42. The third segments 44 of the first and second legs 34, 36 are substantially parallel, but extend in opposite directions perpendicular from the common plane of the center segment 32, first segment 38 and second segment 42.

In an exemplary embodiment, rebar positioner 20 has a width and depth corresponding to a U-shaped bond beam block such that the center segment 32 is positioned at least about 1" from the bottom surface of the channel of the block and the first segments 38 of each of the first and second legs 34, 36 are positioned at least about ½" from the sidewalls of the channel of the bond beam block. In another embodiment, the center segment 32 is suspended such that the rebar 30 is positioned within the bottom one-third of the bond beam.

As shown, the wire has a circular cross-section, although it is envisioned and intended that the wire can have any cross-sectional shape. The gauge of the wire may be selected based upon the diameter and weight of the rebar, and the number of rebar pieces being supported by each rebar positioner 20. The rebar positioner 20 may be constructed from a continuous length of wire or constructed from individual segments attached together, for example, by welding. The wire may be bare or galvanized dipped for resistance to corrosion. The number of undulating curves of the center segment 32 may vary based upon the desired spacing between rebar, the number of rebar being supported, and the width of the corresponding block.

Second Embodiment

Figure 10:
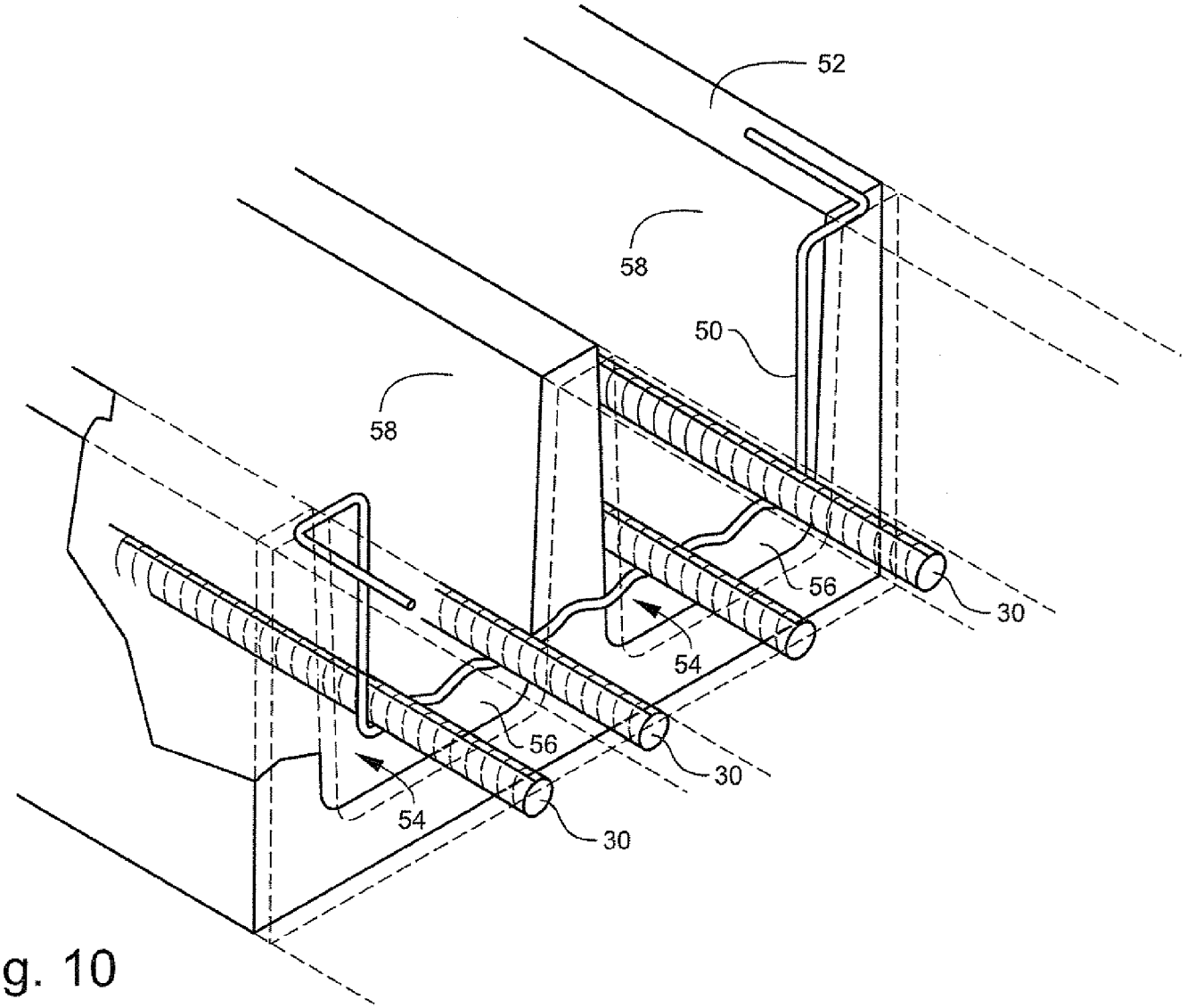
FIG. 10 is a perspective view of a second embodiment of a rebar positioner shown installed in a bond beam.
Figure 11:
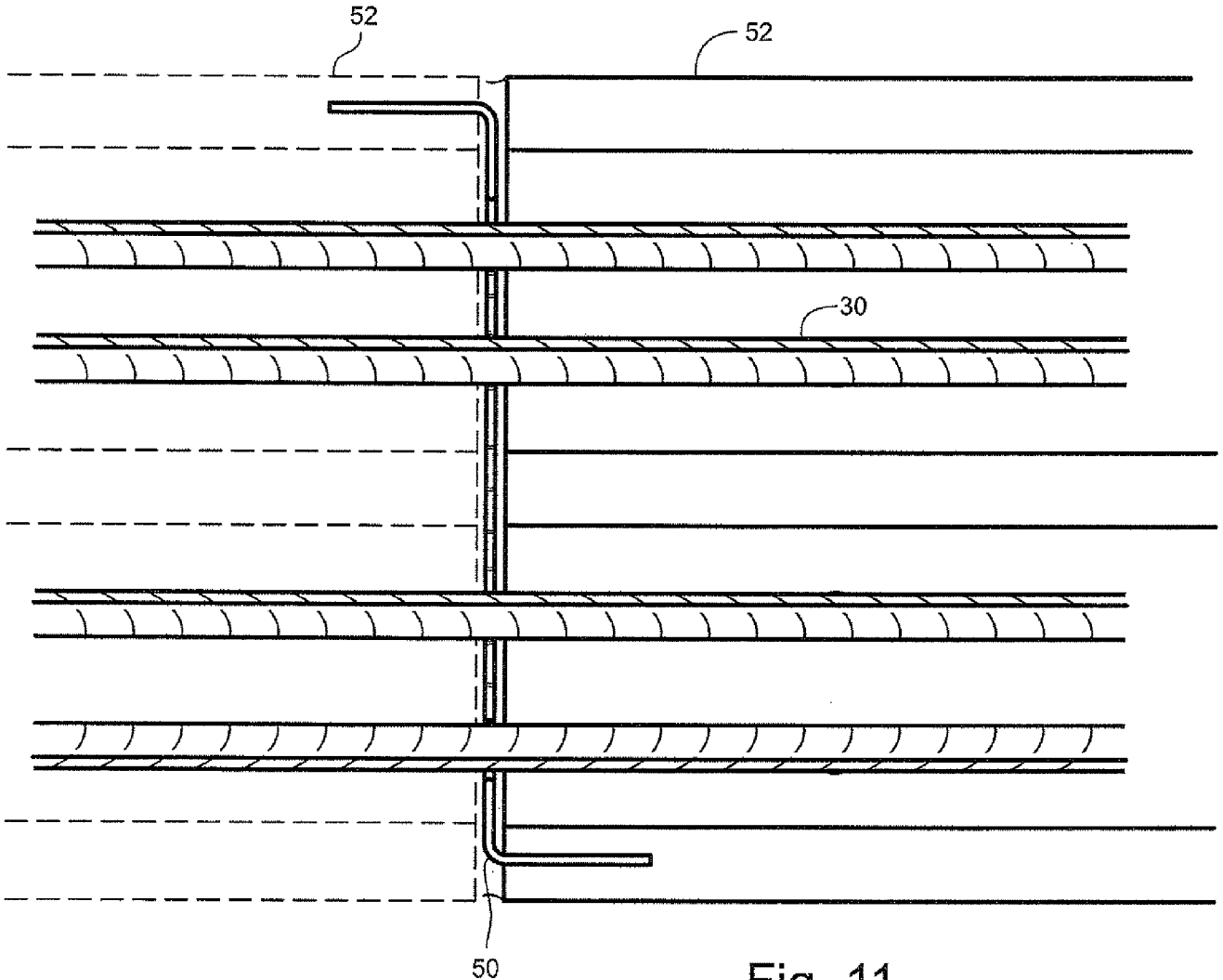
FIG. 11 is a top plan view of the second embodiment of a rebar positioner shown installed in a bond beam between blocks.
Figure 12:
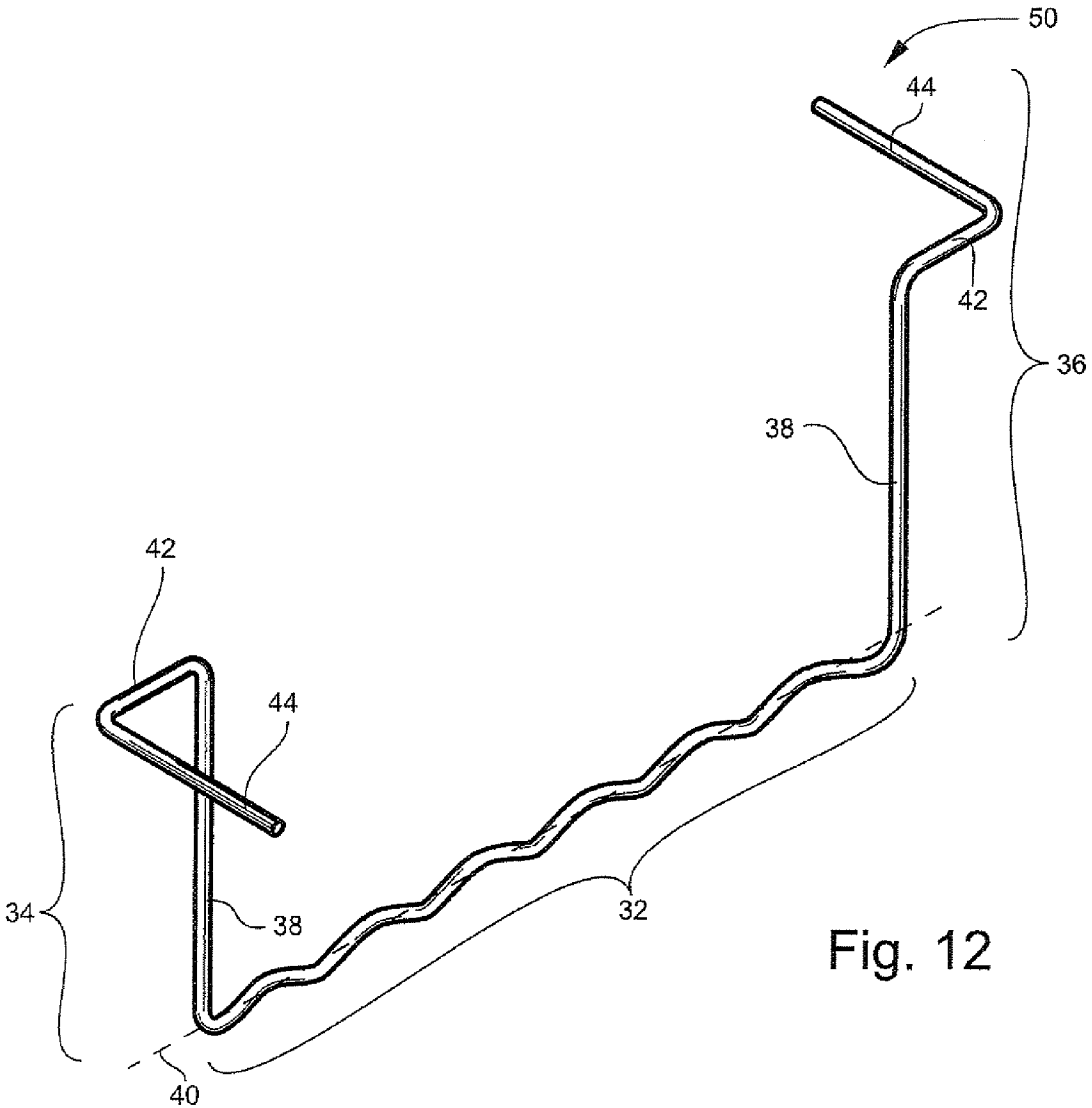
FIGS. 12-18 are various perspective, plan and elevation views of the second embodiment of a rebar positioner.
Figure 13:
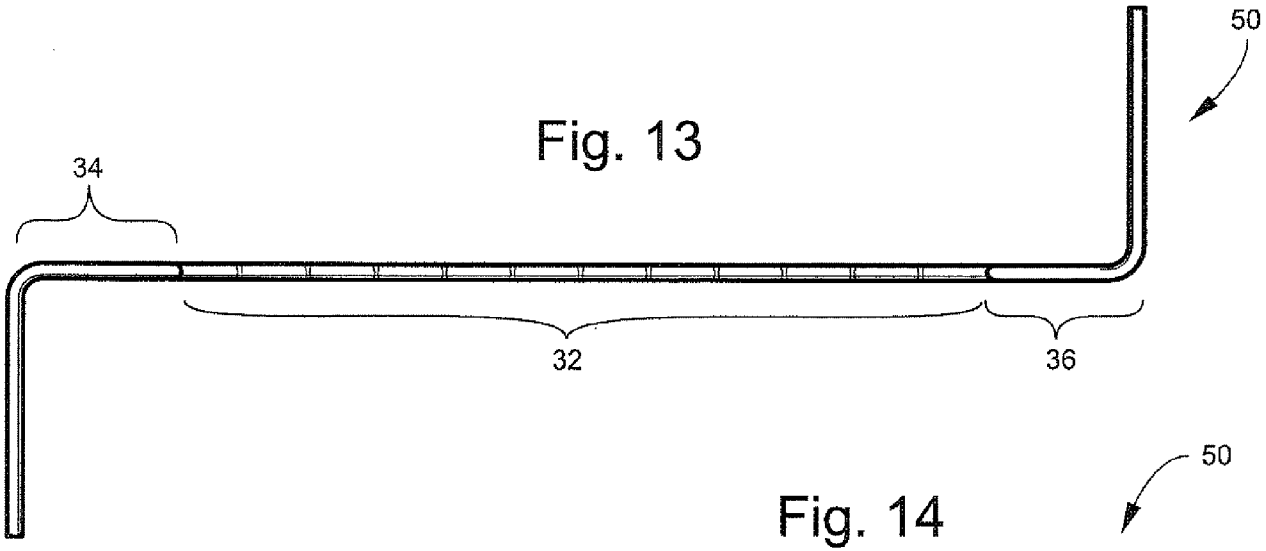
Figure 14:
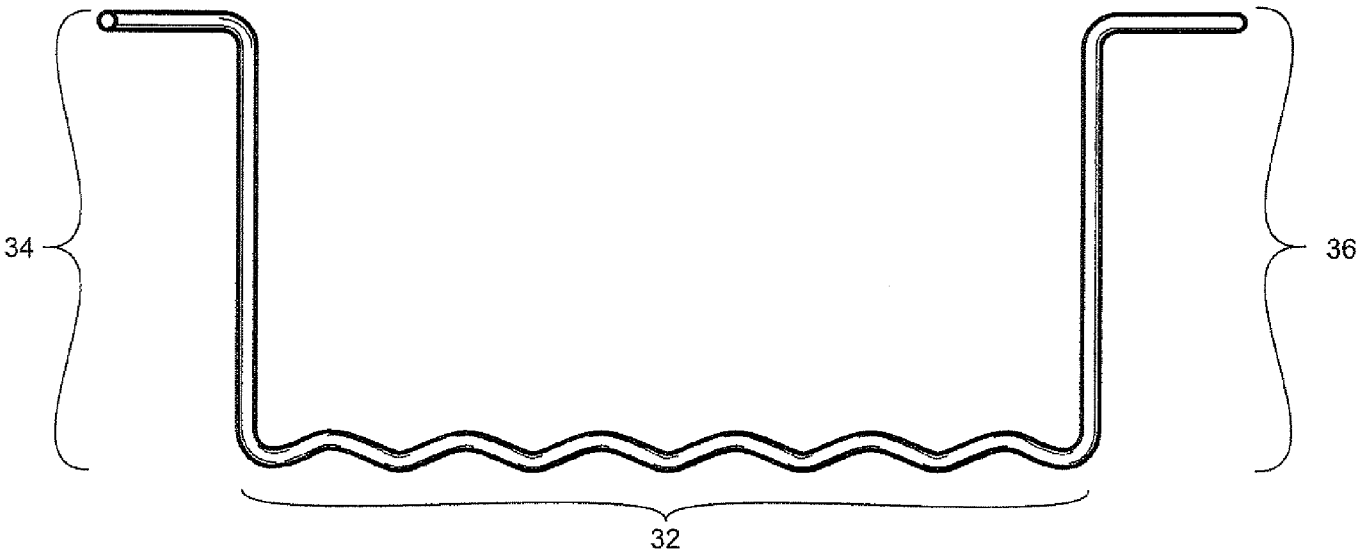
Figure 15:
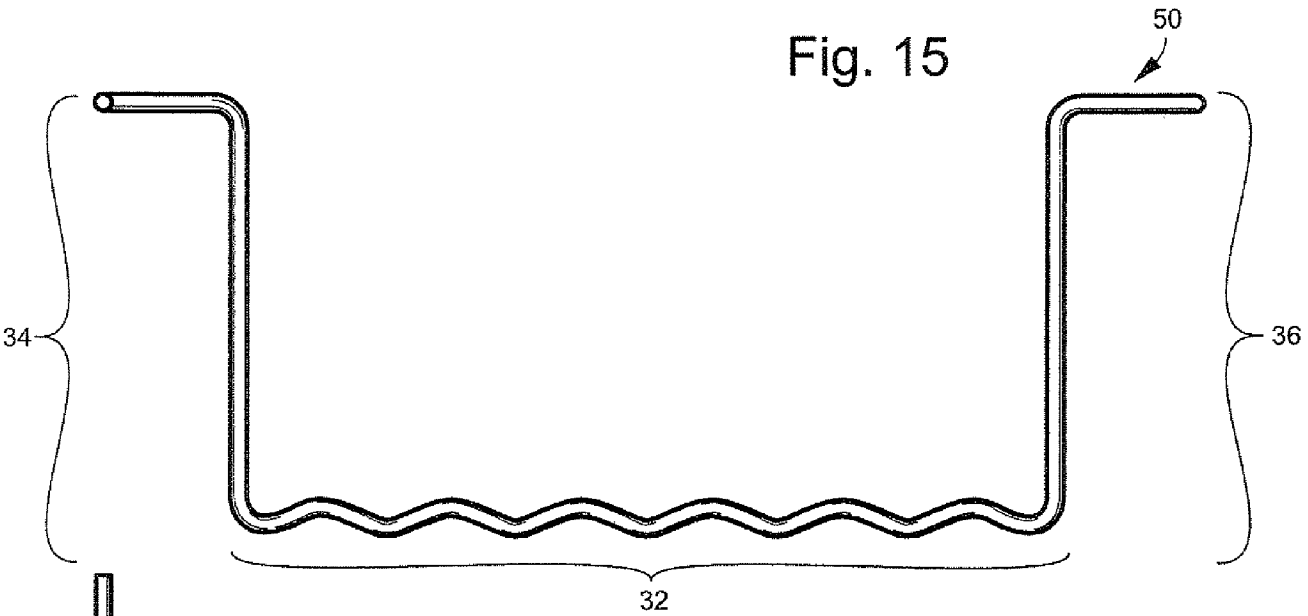
Figure 16:
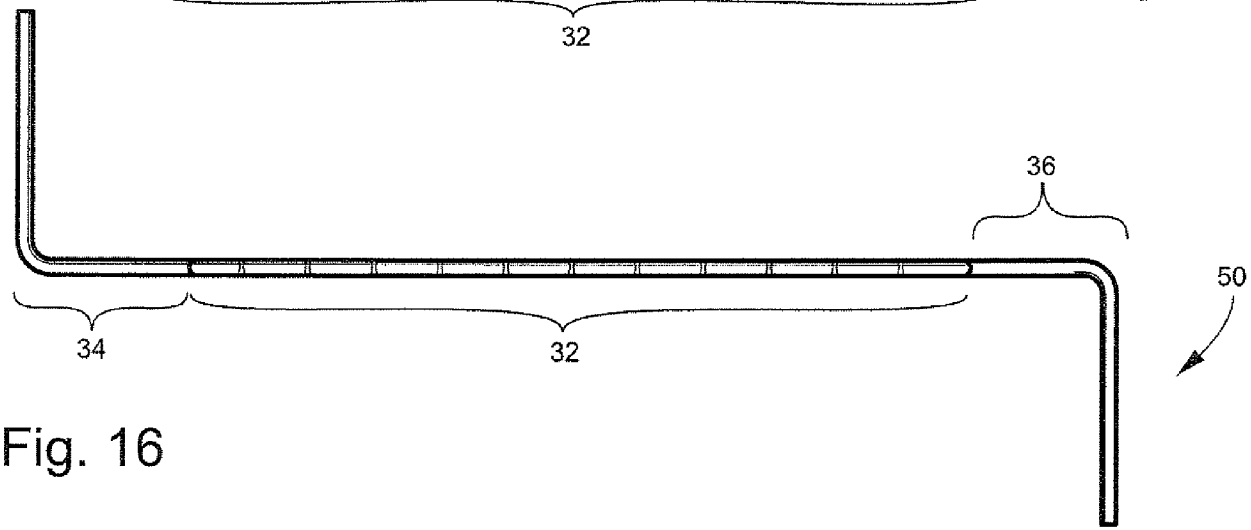
Figure 17:
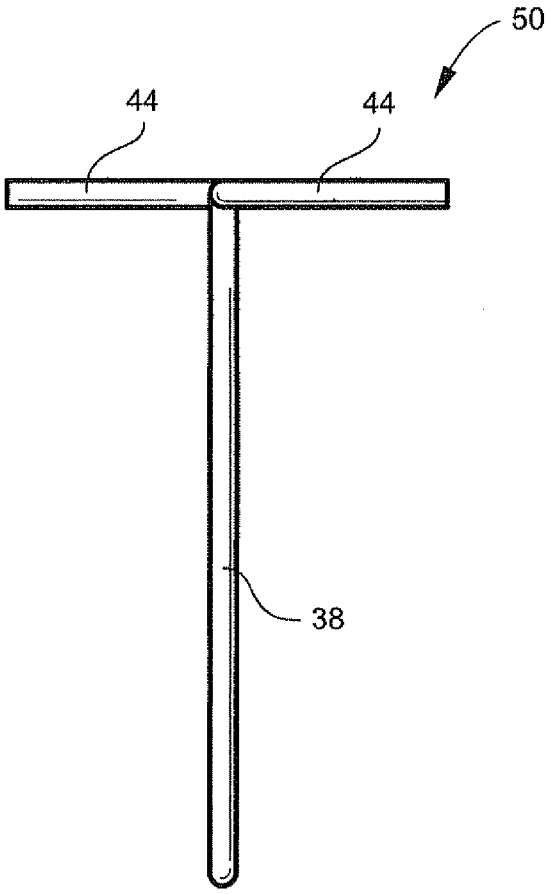
Figure 18:
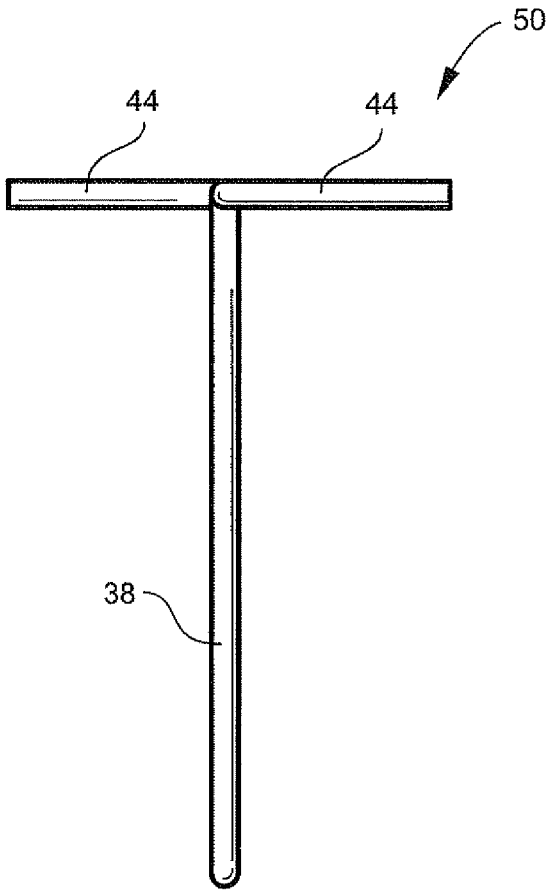

Referring to FIGS. 10-18, a second embodiment of a rebar positioner is shown generally at reference numeral 50. Referring specifically to FIGS. 10-11, rebar positioner 50, in the exemplary application shown, functions to properly position a plurality of rebar within adjacent channels of a bond beam such that the rebar is properly positioned with respect to the bottom and sides of the channels, and with respect to other rebar, during bond beam construction.

Exemplary bond beam masonry block 52, referred to herein as simply "block 52," is generally W-shaped and defines adjacent channels 54 that open to the top of the block 52. To construct a structural bond beam, one or more blocks having a common sectional profile are arranged end-to-end to form continuous, adjacent channels. Rebar is positioned within the channels using positioner 50, and the channels are subsequently filled with poured concrete or other material to embed the rebar and form a substantially solid bond beam. Bond beams constructed using positioner 50 can be used, for example, as structural beams between courses of standard block.

The "W" shape of block 52, and particularly the center vertical extension of block 52, prevents the positioner 50 from being installed mid-span along the length of a single block, and thus requires that the rebar positioner 50 be positioned between adjacent blocks, and in the exemplary embodiment shown, be cooperatively supported by adjacent blocks. As described in detail below with regard to the geometry of rebar positioner 50, the third segment of the first leg of the positioner is supported on one of the adjacent blocks, and the third segment of the second leg of the positioner is supported on the other of the adjacent blocks.

The shape of rebar postioner 50, which is described in detail below with reference to FIGS. 12-18, positions a center segment of positioner 50 elevated from the bottom 56 of the channels 54 and apart from one of the sides 58 of each channel 54. The center segment of the positioner has an undulating shape for supporting rebar 30 having any diameter. As shown, rebar positioner 50 supports and maintains the position of two parallel arranged, spaced-apart lengths of rebar 30 in each channel 54. In the preferred embodiment, the rebar 30 is spaced-apart from the bottom 56 of the channels 54 at least about 1", and spaced-apart from the sides 58 of the channel 54 at least about ½". These distances may vary depending upon bond beam specifications.

The number of rebar positioners 50 required along the length of a bond beam can be dependent upon the length of the beam, number of rebar positioned in the channels, and structural specifications of the bond beam. The undulating shape of the center segment of the rebar positioner 50 allows the positioner to accommodate various diameters of rebar.

Referring specifically to FIGS. 12-18, various perspective, plan and elevation views of rebar positioner 50 are shown. Rebar positioner 50 can be constructed from a single continuous piece of wire bent to generally define a center segment 32 centered between first and second legs 34, 36. The center segment 32 has an undulating form including a plurality of successive curves in alternate directions, preferably at least about ten, more preferably at least about thirteen. The first and second legs 34, 36 extend vertically upwardly from the center segment 32 in substantially the same direction. As compared with the first embodiment of the rebar positioner 20, the second embodiment of the rebar positioner 50 has a longer center segment 32 with a greater number of successive curves.

Each of the first and second legs 34, 36 generally include three segments: a first segment 38 arranged substantially perpendicular with respect to a notional straight line 40 longitudinally bisecting the undulating center segment 32; a second segment 42 arranged perpendicular to the first segment 38, substantially parallel to the notional straight line 40 bisecting the center segment 32, and in a direction away from the center segment 32; and a third segment 44 arranged substantially perpendicular to the second segment 42, coplanar with the second segment 42, and in a direction perpendicular to a common plane of the center segment 32, first segment 38 and second segment 42. The third segments 44 of the first and second legs 34, 36 are substantially parallel, but extend in opposite directions perpendicular from the common plane of the center segment 32, first segment 38 and second segment 42.

In an exemplary embodiment, rebar positioner 50 has a width and depth corresponding to a W-shaped bond beam block such that the center segment 32 is positioned at least about 1" from the bottom surface of the channel of the block and the first segments 38 of each of the first and second legs 34, 36 are positioned at least about ½" from the sidewalls of the channels of the bond beam block. In another embodiment, the center segment 32 is suspended such that the rebar 30 is positioned within the bottom one-third of the bond beam.

As shown, the wire has a circular cross-section, although it is envisioned and intended that the wire can have any cross-sectional shape. The gauge of the wire may be selected based upon the diameter and weight of the supported rebar, and the number of rebar pieces being supported by the rebar positioner 50. The rebar positioner 50 may be constructed from a continuous length of wire or constructed from individual segments attached together, for example, by welding. The wire may be bare or galvanized dipped for resistance to corrosion. The number of undulating curves of the center segment 32 may vary based upon the desired spacing between rebar, the number of rebar being supported, and the width of the corresponding block.

Third Embodiment

Figure 19:
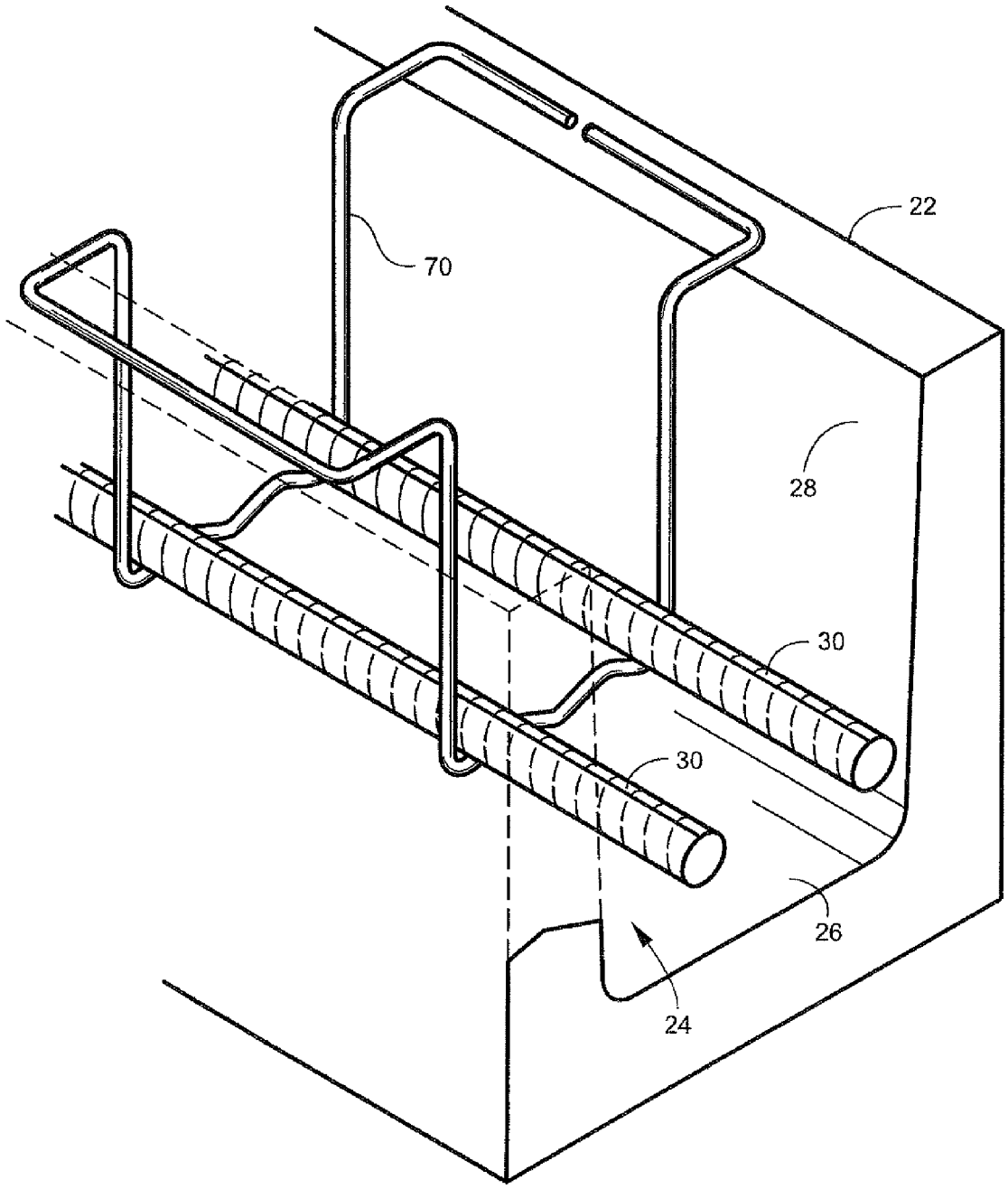
FIG. 19 is a perspective view of a third embodiment of a rebar positioner shown installed in a bond beam masonry block.
Figure 20:
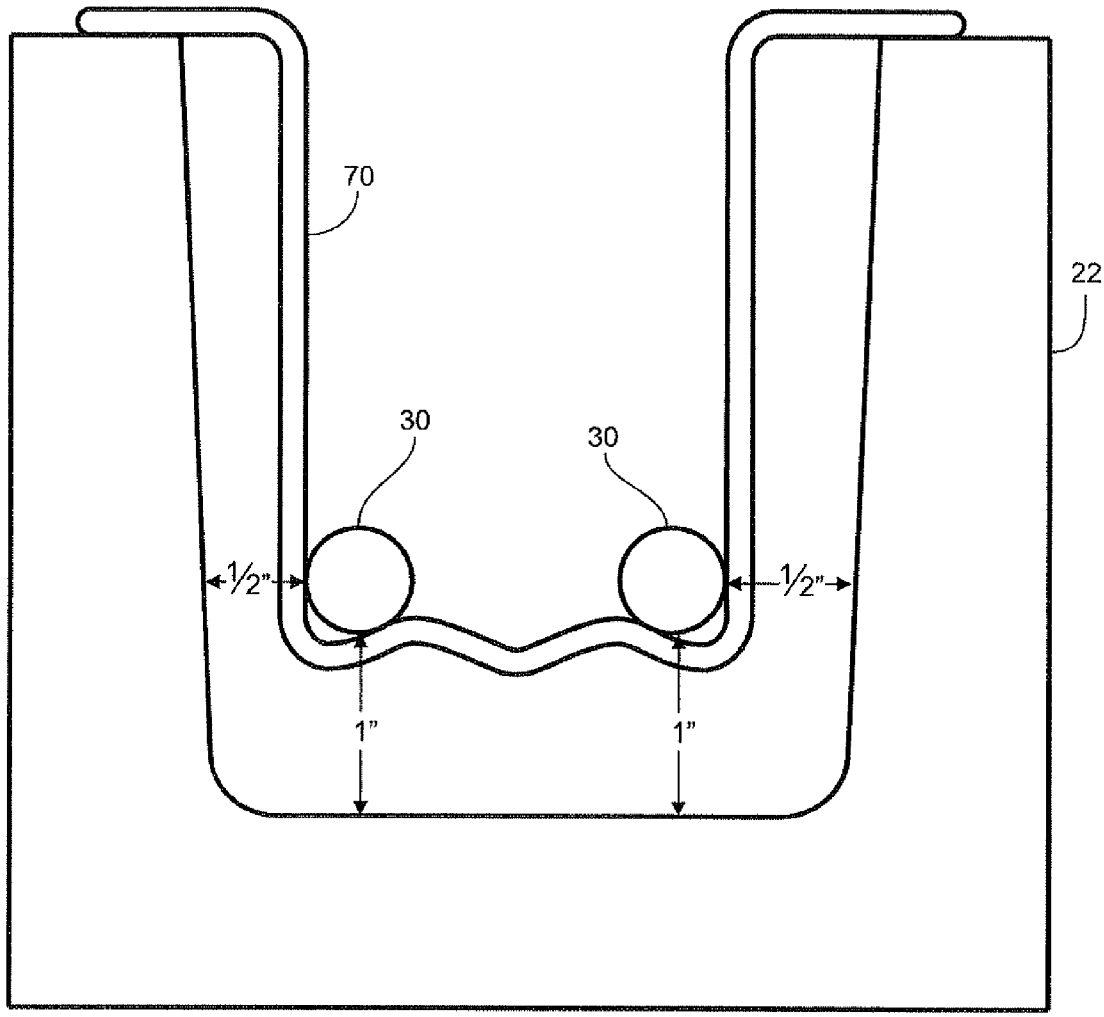
FIG. 20 is a front elevation view of the third embodiment of a rebar positioner shown installed in a bond beam masonry block.
Figure 21:
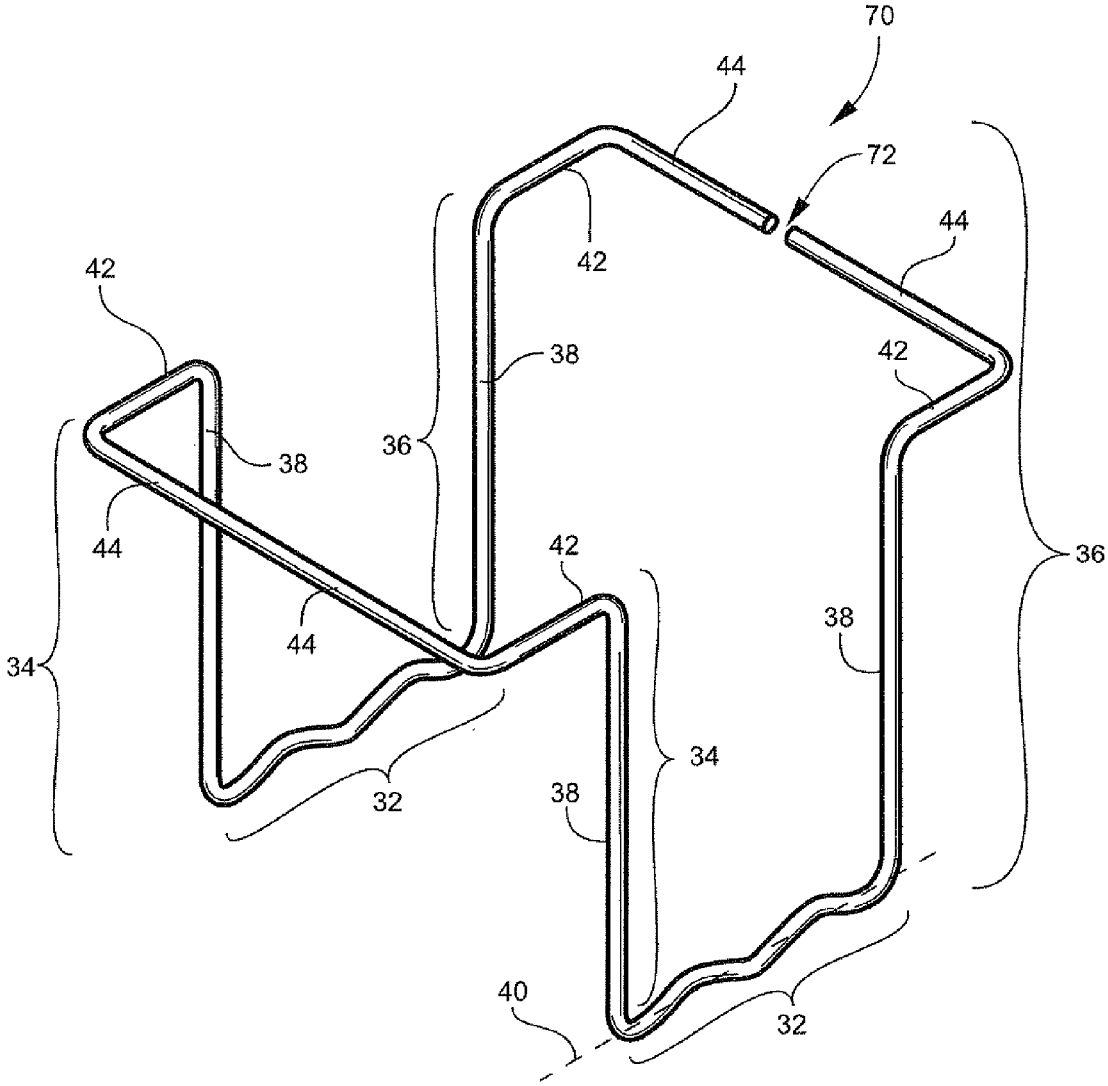
FIGS. 21-27 are various perspective, plan and elevation views of the third embodiment of a rebar positioner.
Figure 22:
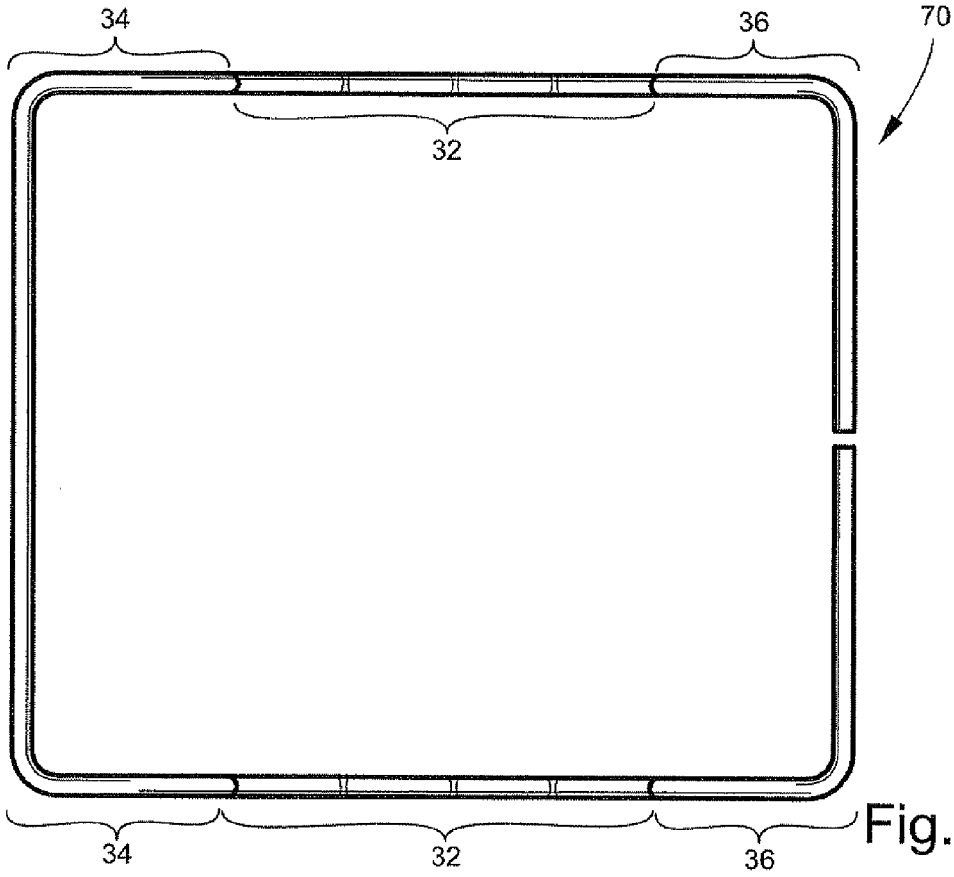
Figure 23:
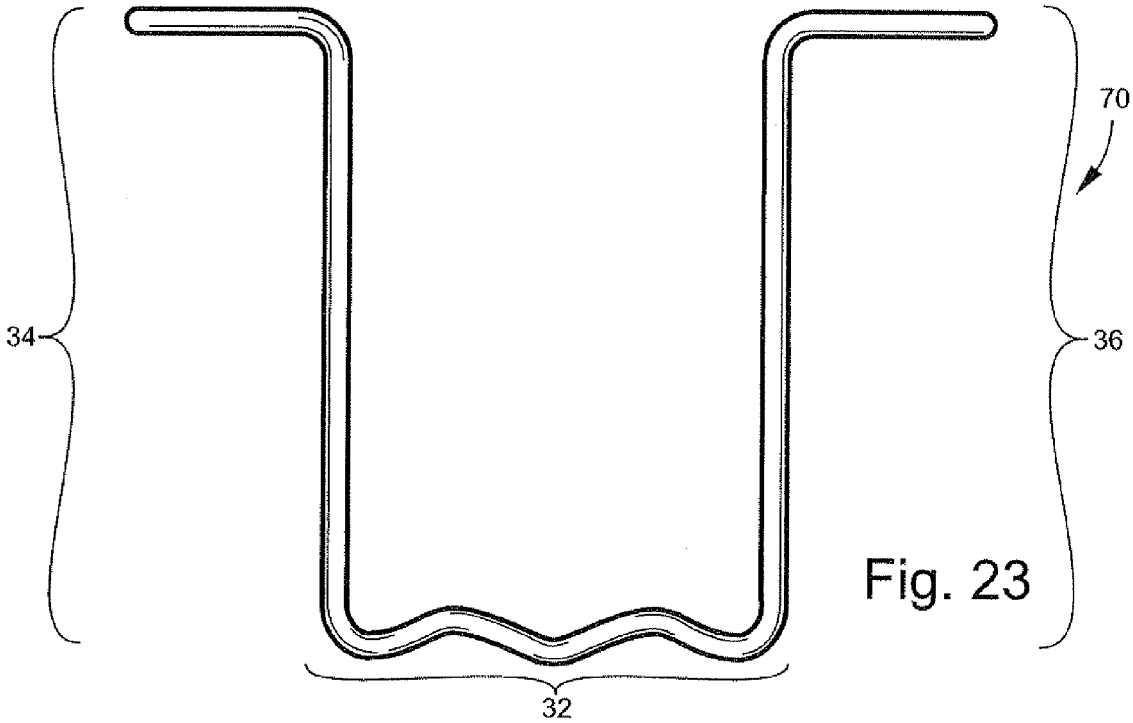
Figure 24:
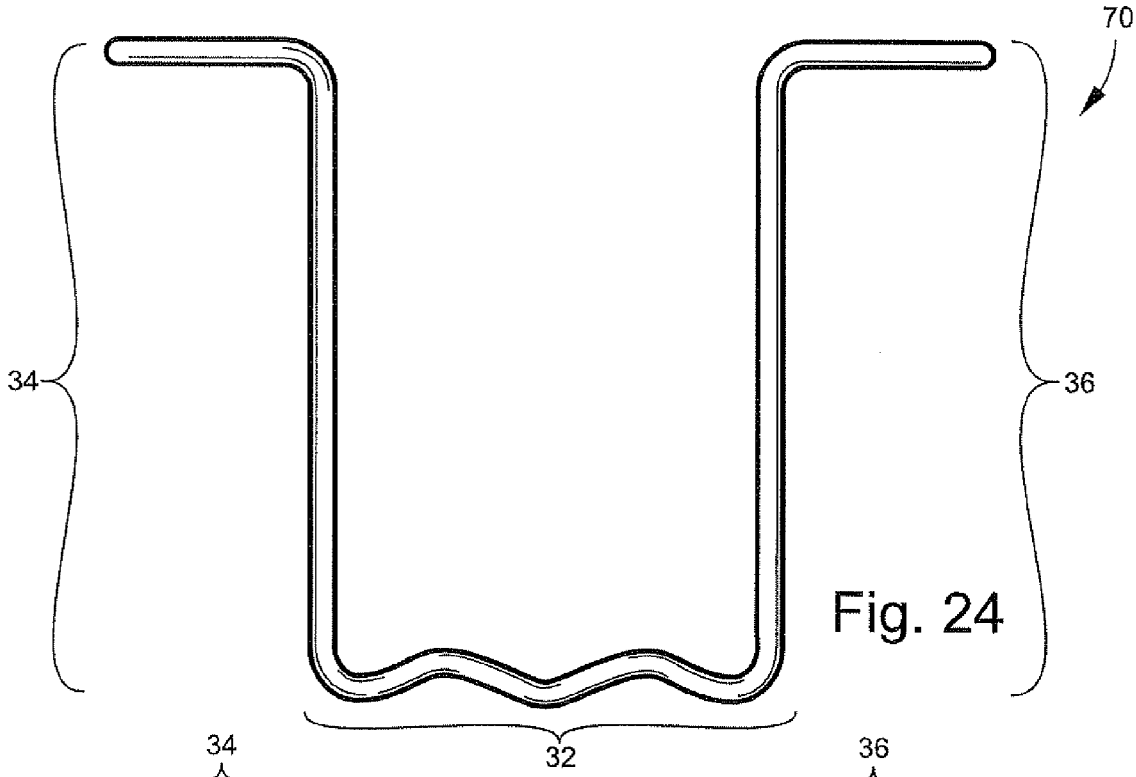
Figure 25:
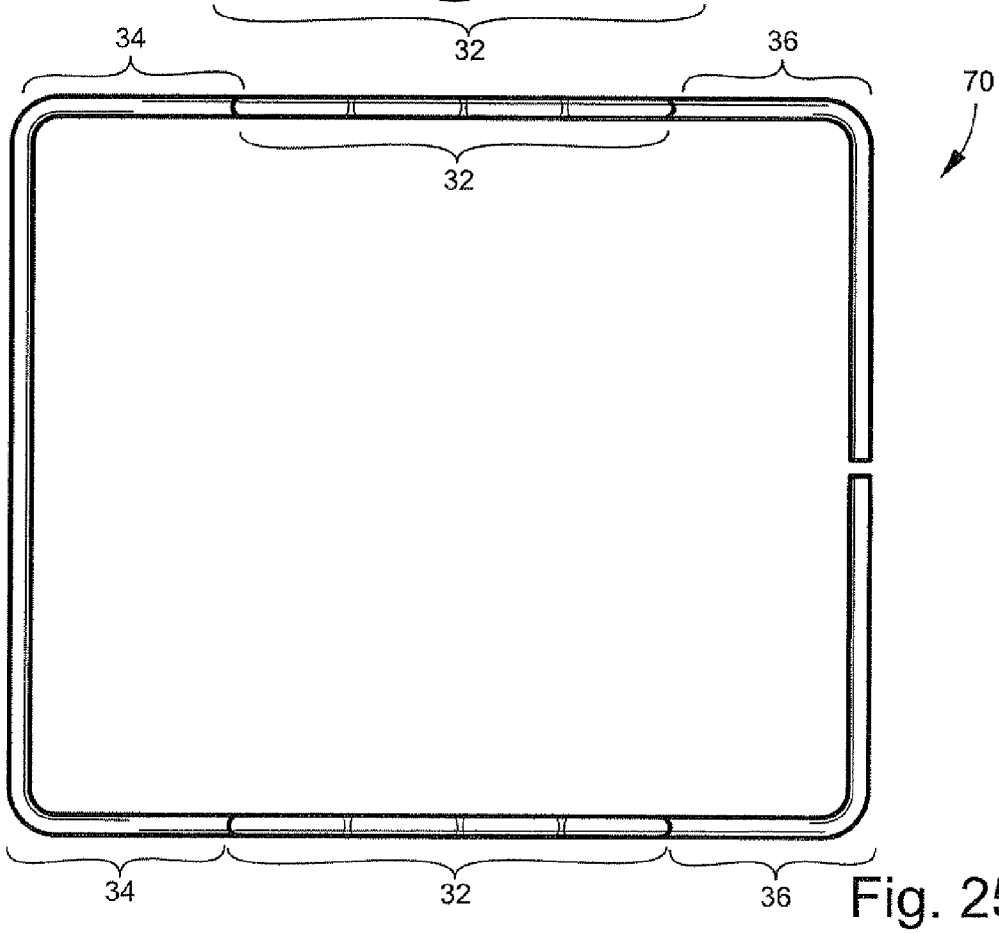
Figure 26:
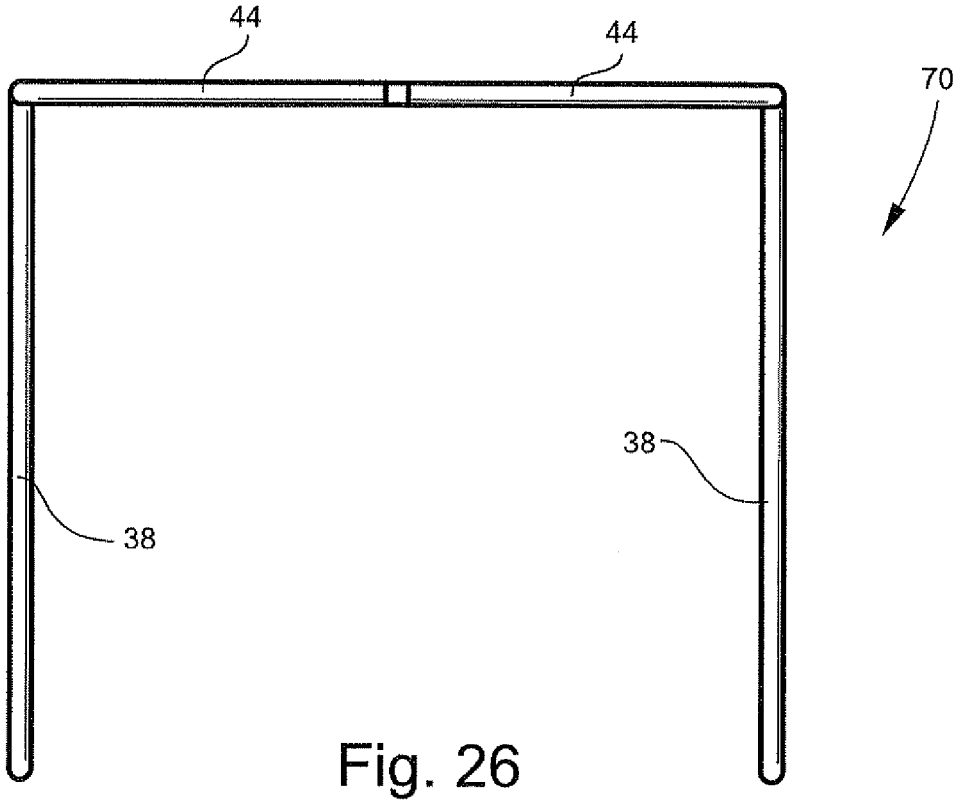
Figure 27:
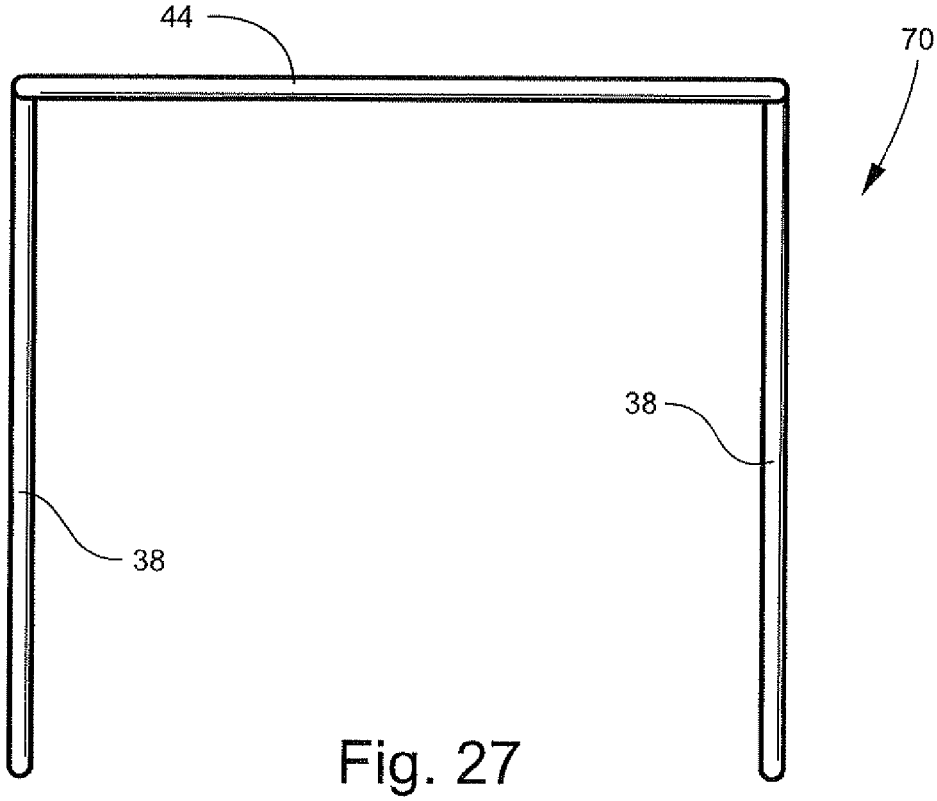

Referring to FIGS. 19-27, a third embodiment of a rebar positioner is shown generally at reference numeral 70. Referring specifically to FIGS. 19-20, rebar positioner 70, in the exemplary application shown, functions to properly position at least one length of rebar within a channel of a bond beam such that the rebar is properly positioned with respect to the bottom and sides of the channel, and with respect to additional lengths or rebar, during bond beam construction.

Exemplary bond beam masonry block 22, referred to herein as simply "block 22," is generally U-shaped and defines a single channel 24 open to the top of the block 22. To construct a structural bond beam, one or more blocks having a common sectional profile are arranged end-to-end to form a continuous channel. Rebar is positioned within the channel using positioner 70, and the channel is subsequently filled with poured concrete or other material to embed the rebar and form a substantially solid bond beam. Bond beams can be used, for example, as structural beams between courses of standard block.

Block 22 generally defines a flat top surface upon which portions of the legs of positioner 70 seat upon and are supported by. The shape of rebar postioner 70, which is described in detail below with reference to FIGS. 21-27, positions center segments of positioner 70 elevated from the bottom 26 of the channel 24 and apart from the sides 28 of the channel 24. The center segments of the positioner have an undulating shape for supporting rebar 30 having any diameter. As shown, rebar positioner 70 supports and maintains the position of two parallel arranged, spaced-apart lengths of rebar 30. In the preferred embodiment, the rebar 30 is spaced-apart from the bottom 26 of the channel 24 at least about 1", and spaced-apart from the sides 28 of the channel 24 at least about ½". These distances may vary depending upon bond beam specifications.

The number of rebar positioners 70 required, and the spacing of the intervals, is dependent upon the length and structural specifications of the bond beam. Although rebar positioner 70 is shown being supported by a single block, it is envisioned that the positioner may be cooperatively supported by adjacent blocks. The undulating shape of the center segments of rebar positioner 70 allow the positioner to accommodate various diameters of rebar.

Referring specifically to FIGS. 21-27, various perspective, plan and elevation views of rebar positioner 70 are shown. Rebar positioner 70 can be constructed from a single continuous piece of wire bent to generally define center segments 32 each centered between first and second legs 34, 36. Each of the center segments 32 have an undulating form including a plurality of successive curves in alternate directions. The first and second legs 34, 36 of each of the center segments 32 extend vertically upwardly from the center segment 32 in substantially the same direction.

The first and second legs 34, 36 of each of the center segments 32 generally include three segments: a first segment 38 arranged substantially perpendicular with respect to a notional straight line 40 longitudinally bisecting its respective undulating center segment 32; a second segment 42 arranged perpendicular to the first segment 38, substantially parallel to the notional straight line 40 bisecting the center segment 32, and in a direction away from the center segment 32; and a third segment 44 arranged substantially perpendicular to the second segment 42, coplanar with the second segment 42, and in a direction perpendicular to a common plane of the center segment 32, first segment 38 and second segment 42. The third segments 44 of the first legs 34 of each of the center segments 32 are connected to form a single, common third segment 44. The third segments 44 of each of the second legs 36 of each of the center segments 32 are arranged in the direction toward one another, but are separated by a break 72, necessitated by constructing the third embodiment of the rebar positioner 70 from a single continuous piece of wire.

In an exemplary embodiment, rebar positioner 70 has a width and depth corresponding to a U-shaped bond beam block such that the center segments 32 are positioned at least about 1" from the bottom surface of the channel of the block and the first segments 38 of each of the first and second legs 34, 36 of each of the center segments 32 are positioned at least about ½" from the sidewalls of the channel of the bond beam block. In another embodiment, the center segments 32 are suspended such that the rebar 30 is positioned within the bottom one-third of the bond beam.

As shown, the wire has a circular cross-section, although it is envisioned and intended that the wire can have any cross-sectional shape. The gauge of the wire may be selected based upon the diameter and weight of the supported rebar, and the number of rebar pieces being supported by the rebar positioner 70. The rebar positioner 70 may be constructed from a continuous length of wire or constructed from individual segments attached together, for example, by welding. The wire may be bare or galvanized dipped for resistance to corrosion. The number of undulating curves of the center segments 32 may vary based upon the desired spacing between rebar, the number of rebar being supported, and the width of the corresponding block. The third embodiment of the rebar positioner 70 can be used as a substitute for the first embodiment of the rebar positioner 20 when the rebar is either heavy or has a short length.

The foregoing description of exemplary embodiments of rebar positioners has been provided for the purpose of illustration and description. It is not intended to be exhaustive or to limit the rebar positioners to the precise forms disclosed. Many modifications and variations will be apparent to those of ordinary skill in the art.

What is claimed is:

1. A bond beam rebar positioner, comprising:

(a) a center segment having an undulating form including a plurality of successive curves in alternate directions wherein axes of the curves extend in a generally vertical direction; and (b) first and second legs extending from opposing ends of the center segment, each of the first and second legs comprising:

(i) a first segment arranged substantially perpendicular with respect to the notional straight line longitudinally bisecting the successive curves of the center segment;

(ii) a second segment arranged perpendicular to the first segment, substantially parallel to the notional straight line bisecting the center segment, and in a direction away from the center segment; and (iii) a third segment arranged perpendicular to the second segment, coplanar with the second segment, and in a plane perpendicular to a common plane of the center segment, the first segment and the second segment.

2. The bond beam rebar positioner according to claim 1, wherein the third segments of the first and second legs are substantially parallel and extend in opposite directions perpendicular from the common plane of the center segment, the first segment and the second segment.

3. The bond beam rebar positioner according to claim 1, wherein the center segment includes at least five successive curves.

4. The bond beam rebar positioner according to claim 1, wherein the center segment includes at least ten successive curves.

5. The bond beam rebar positioner according to claim 1, wherein when the rebar positioner is installed within a bond beam block, the center segment is elevated about 1" inch off a bottom of a channel of the block and the first segments of each of the first and second legs are spaced-apart about ½" inch from sidewalls of the channel.

6. The bond beam rebar positioner according to claim 1, wherein the first segment of each of the first and second legs extends from the center segment in substantially the same direction.

7. The bond beam rebar positioner according to claim 1, further comprising a second center segment spaced-apart and arranged parallel to the center segment, the second center segment including first and second legs attached to opposing ends thereof, each of the first and second legs including a first segment arranged substantially perpendicular with respect to a notional straight line longitudinally bisecting the successive curves of the second center segment, a second segment arranged perpendicular to the first segment, substantially parallel to the notional straight line bisecting the center segment, and in a direction away from the center segment, and a third segment arranged substantially perpendicular to the second segment, coplanar with the second segment, and in a direction perpendicular to a common plane of the center segment, the first segment and the second segment.

8. The bond beam rebar positioner according to claim 7, wherein the third segment of the first leg of the center segment and the third segment of the first leg of the second center segment are connected.

9. The bond beam rebar positioner according to claim 7, wherein the third segment of the second leg of the center segment and the third segment of the second leg of the second center segment are arranged in a direction toward one another and are separated by a space.

10. The bond beam rebar positioner according to claim 1, wherein the rebar positioner is constructed from a continuous wire bent to define the center segment and the first and second legs.

11. The bond beam rebar positioner according to claim 10, wherein the wire has a circular cross-section.

12. The bond beam rebar positioner according to claim 10, wherein the wire is treated for corrosion resistance.

13. The bond beam rebar positioner according to claim 10, wherein the wire is galvanized.

* * * * *